US005564274A

United States Patent [19]

Denbraber et al.

[11] Patent Number: 5,564,274

[45] Date of Patent: Oct. 15, 1996

[54] COLD OIL PROTECTION CIRCUIT FOR A HYDRAULIC SYSTEM

[75] Inventors: Lee R. Denbraber, Peoria; Mark R. Hawkins, Chillicothe; David R. Meinhold, Metamora; Steven J. Zmuda, Dunlap, all of Ill.

[73] Assignee: Caterpillar Inc., Peoria, Ill.

[21] Appl. No.: 571,422

[22] Filed: Dec. 13, 1995

[51] Int. Cl.[6] ..... F15B 13/08; F15B 21/04

[52] U.S. Cl. ..... 60/329; 60/427; 91/419; 91/459; 137/468; 137/625.64

[58] Field of Search ..... 60/329, 427; 91/419, 91/459; 137/468, 625.64

[56] References Cited

U.S. PATENT DOCUMENTS 4,712,376 12/1987 Hadank et al. ..... 60/427

FOREIGN PATENT DOCUMENTS 4-258504 9/1992 Japan .
2278465 5/1995 United Kingdom .

*Primary Examiner*—Gerald A. Michalsky
*Attorney, Agent, or Firm*—J. W. Burrows

[57] ABSTRACT

A cold fluid protection circuit is provided for controlling the rate of fluid flow in a hydraulic system in response to the temperature of the oil in a reservoir. The subject invention includes a temperature sensor operative to sense the temperature of the fluid in the reservoir and deliver an electrical signal representative thereof to a controller. The controller processes the sensed temperature with respect to the rate of flow in the hydraulic system that is returning to the reservoir from an actuator through a fluid conditioning mechanism and proportionally reduces the rate of flow therethrough by controllably reducing the displacement of a directional valve mechanism in response to the sensed temperature.

7 Claims, 1 Drawing Sheet

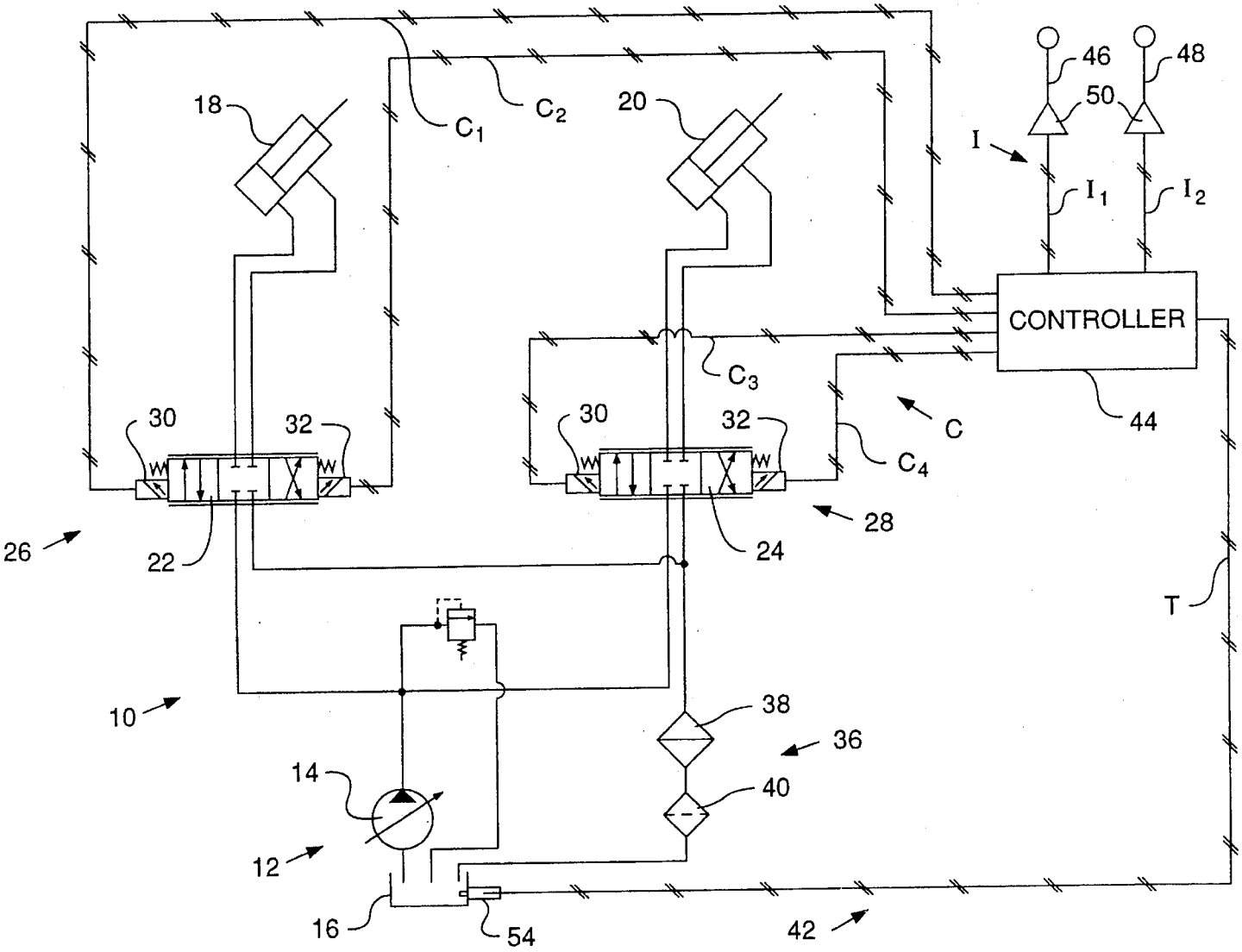
CONTROLLER
44
48
46
50
$I_2$
$I_1$
I
T
C
$C_4$
28
36
42
38
40
24
32
$C_3$
20
30
$C_2$
$C_1$
54
14
16
12
18
22
10
26

COLD OIL PROTECTION CIRCUIT FOR A HYDRAULIC SYSTEM

TECHNICAL FIELD

This invention relates generally to a hydraulic system having a fluid system with a cooler or other fluid conditioning mechanism to control the temperature of the fluid within the hydraulic system and more particularly to a circuit to protect the system when the fluid in the system is cold.

BACKGROUND ART

When operating a fluid system in a cold environment or when first starting the engine of the machine, the fluid may be cold and its viscosity very high. Under these conditions if one or more actuators are moved, the volume of fluid flowing through the system may be high. Since the fluid's viscosity is high, it is very difficult to force the fluid through various components of the system, such as the cooler and/or filters. In known systems, attempting to force the fluid through the system has resulted in damage or destruction to some of the system components due to high fluid pressures resulting to resistance to flow. Whenever the fluid temperature of the fluid is below a predetermined level, it is desirable to decrease the fluid flow through the system. Various attempts have been used to offset the above noted problem. One attempt has been to provide a bypass around the cooler or other components whenever the pressure of the return fluid is above a predetermined pressure level. Another attempt has been to reduce the speed of the fan of the cooler responsive to the temperature of the fluid in order to more quickly increase the temperature of the fluid. In other attempts, a bypass valve has been provided to bypass the fluid flow from the pump to the reservoir if the temperature of the fluid is below a predetermined level. The pump's bypassed fluid flow still must be returned to the reservoir through some path and if the volume of fluid is large enough, damage to the cooler, filters, or other components may still occur.

The present invention is directed to overcoming one or more of the problems set forth above.

DISCLOSURE OF THE INVENTION

In one aspect of the present a cold fluid protection circuit is provided for use in a hydraulic system having a source of pressurized fluid which receives fluid from a reservoir and directs the pressurized fluid to an actuator through a directional valve mechanism, an electro-hydraulic proportional valve mechanism that controls movement of the directional valve mechanism in proportion to the magnitude of an input command, and a fluid conditioning mechanism operative to condition the fluid in the system. The cold fluid protection circuit comprises a temperature sensor associated with the reservoir and operative to generate a signal that is representative of the temperature of the fluid in the reservoir and a controller operative to receive and process the input command and output an electrical command to the electro-hydraulic proportional valve mechanism that is proportional to the input command. The controller receives the signal from the temperature sensor that represents the temperature of the fluid in the reservoir and modifies the electrical command to the electro-hydraulic proportional valve mechanism to proportionally reduce the flow across the directional valve mechanism and the flow through the fluid conditioning mechanism when the temperature of the fluid is below a predetermined level.

BRIEF DESCRIPTION OF THE DRAWINGS

The drawing is a schematic representation of a hydraulic system incorporating an embodiment of the present invention.

BEST MODE FOR CARRYING OUT THE INVENTION

Referring to the drawing, a hydraulic system 10 is illustrated and includes a source of pressurized fluid 12, such as a variable displacement pump 14, a reservoir 16, first and second actuators 18,20, first and second directional valve mechanisms 22,24, and respective first and second electro-hydraulic proportional valve mechanisms 26,28. Each of the first and second electro-hydraulic proportional valve mechanisms 26,28 has first and second electrically actuated proportional valves 30,32.

A fluid conditioning mechanism 36 is disposed in the hydraulic system 10 to condition the fluid. The fluid conditioning mechanism 36 is located in the return from the actuators 18,20 to the reservoir 16 and includes a fluid cooler arrangement 38 and a fluid filter arrangement 40. As is well known, the fluid cooler arrangement 38 could include a cooling fan, bypass valve or other well known components without departing from the essence of the invention. Likewise, the filter arrangement 40 could include several filters arranged in parallel or series.

A cold fluid protection circuit 42 is provided to control the rate of fluid flow within the hydraulic system 10 and through the fluid conditioning mechanism 36 based on the temperature of the fluid within the reservoir 16. The cold fluid protection 10 circuit 42 includes a controller 44, such as a microprocessor, that is operative to receive and process an input command "I" in the form of electrical signals "$I_1$,$I_2$" from first and second levers 46,48 of a pair of joystick controls 50.

The controller 44 generates and delivers an electrical command "C" to the electro-hydraulic proportional valve mechanisms 26,28. The command "C" includes first and second electrical signals "$C_1$,$C_2$" directed to the respective first and second electrically actuated proportional valves 30,32 of the first electro-hydraulic proportional valve mechanism 26. The command "C" also includes third and fourth electrical signals "$C_3$,$C_4$" directed to the respective first and second electrically actuated proportional valves 30,32 of the second electro-hydraulic proportional valve mechanism 28.

The cold fluid protection circuit 42 also includes a temperature sensor 54 operative to sense the temperature of the fluid in the reservoir 16 and deliver an electrical signal "T" to the controller 44 that is representative of the sensed temperature. Even though the temperature sensor 54 is illustrated mounted to the reservoir 16, it is recognized that the temperature sensor could be connected to the inlet line between the reservoir 16 and the pump 14.

Even though only two actuators 18,20 and their related valves are illustrated and described, the subject hydraulic system 10 could have other actuators and related valves without departing from the essence of the invention. The controller 44 would control the additional actuator and related valves in the same manner as described herein. Likewise, even though joystick controls 50 are illustrated, other types of pilot controls could be used.

INDUSTRIAL APPLICABILITY

In the operation of the hydraulic system 10, the operator makes an input to one or both of the control levers 44,46 to control the operation of the respective actuators 18,20. Since each of the actuators 18,20 are controlled in basically the same manner from an input to either of the control levers 44,46, the controlled operation of only one of the actuators 18,20 will be described in detail.

Movement of the lever 46 generates the electrical signal "$I_1$" that represents the direction of movement of the actuator 18 and the electrical signal "$_r$" is also proportional to the degree of movement of the control lever 46. The controller 44 processes the input electrical signal "$I_1$" and delivers an electrical signal "$C_1$" or "$C_2$" to the respective one of the first and second electrically actuated proportional valves 30,32 of the first electro-hydraulic proportional valve mechanism 26. If the movement of the control lever 46 indicates extension of the actuator 18, then the controller 44 generates and delivers the electrical signal "$C_1$" to the first electrically actuated proportional valve 30 of the first electrohydraulic proportional valve mechanism 26. The first electrically actuated proportional valve 30 generates a proportional force to move the directional valve mechanism to an actuated position to extend the actuator 18.

If it is desired to retract the actuator 18, the control lever 46 is moved in the opposite direction and the controller 44 generates and delivers the electrical signal "$C_2$", that is proportional to the degree of movement of the control lever 46, to the second electrically actuated proportional valve 32. The second electrically actuated proportional valve 32 generates a proportional force to move the directional valve mechanism 22 to an operative position to retract the actuator 18.

During extension or retraction of either or both of the actuators 18,20, the exhaust fluid therefrom is returned to the reservoir 16 through the cooler arrangement 38 and the filter arrangement 40.

It is well known that the viscosity of fluids changes as the temperature thereof changes. In hydraulic systems, the hydraulic oil is more viscous when the oil is cold. Consequently, it is very difficult to force the oil through the components of the system at needed higher velocities as dictated by the rate of return oil coming from the actuators 18,20. When cold oil is being forced to flow through the cooler arrangement 38 and/or the filter arrangement 40 at a higher rate of flow, high pressures are created due to the resistance to flow therethrough. Consequently, the system components may be damaged by the high pressure.

In the subject arrangement, the controller 44 is continually sensing the temperature of the oil in the reservoir 16 and comparing the sensed temperature to the calculated rate of flow that is being returned to the reservoir 16 through the fluid conditioning mechanism 36. If the return rate of fluid flow is too large relative to the viscosity of the fluid, as determined by the sensed temperature, the controller 44 proportionally reduces the flow to and from the respective actuators 18,20 by moving the respective directional valve mechanisms 22,24 to limit fluid flow therethrough. This is accomplished by changing the respective electrical signals "$C_1$,$C_2$,$C_3$ or $C_4$" depending on which ones are being energized. Once the temperature of the fluid is high enough to allow a larger fluid flow rate through the hydraulic system 10 across the fluid conditioning mechanism 36, the controller 44 resets the respective electrical signals "$C_1$,$C_2$,$C_3$ or $C_4$" to the level established by the original position of the respective control levers 46,48.

In view of the foregoing, the subject invention provides a cold fluid protection circuit 42 which ensures that components such as coolers, filters, etc. can be protected from damage resulting from forcing high viscous fluid flow thereacross. This is accomplished by reducing the volume of fluid flow across the directional valve mechanisms 22,24 when the temperature of the oil (fluid) in the reservoir 16 is below a predetermined level.

Other aspects, objects and advantages of the invention can be obtained from a study of the drawings, the disclosure and the appended claims.

We claim:

1. A cold fluid protection circuit for a hydraulic system having a source of pressurized fluid which receives fluid from a reservoir and directs the pressurized fluid to an actuator through a directional valve mechanism, an electro-hydraulic proportional valve mechanism that controls movement of the directional valve mechanism in proportion to the magnitude of an input command, and a fluid conditioning mechanism operative to condition the fluid in the system, the cold fluid protection circuit comprises:

a temperature sensor operatively associated with the fluid in the reservoir and operative to generate a signal that is representative of the temperature of the fluid in the reservoir; and a controller operative to receive and process the input command and output an electrical command to the electro-hydraulic proportional valve mechanism that is proportional to the input command, the controller receives the signal from the temperature sensor that represents the temperature of the fluid in the reservoir and modifies the electrical command to the electro-hydraulic proportional valve mechanism to proportionally reduce the flow across the directional valve mechanism and the flow through the fluid conditioning mechanism when the temperature of the fluid is below a predetermined level.

2. The cold fluid protection circuit of claim 1 wherein the electro-hydraulic proportional valve mechanism includes first and second electrically actuated proportional valves respectively connected to opposite ends of the directional valve mechanism and the electrical command includes first and second electrical signals connected to the respective first and second proportional valves.

3. The cold fluid protection circuit of claim 2 wherein the input command is an electrical signal generated by movement of a control lever.

4. The cold fluid protection circuit of claim 3 wherein the hydraulic system is adapted to have more than one actuator and associated electro-hydraulic proportionally controlled directional valve mechanisms with respective electrical commands from the controller and the controller is operative to proportionally reduce the flow across each of the directional valve mechanisms when the temperature of the fluid is below the predetermined level.

5. The cold fluid protection circuit of claim 4 wherein the controller is a microprocessor.

6. The cold fluid protection circuit of claim 5 wherein the fluid conditioning mechanism includes a fluid cooler arrangement.

7. The cold fluid protection circuit of claim 6 wherein the fluid conditioning mechanism further includes a filter arrangement.

* * * * *